US012729553B2

(12) United States Patent
Coelho et al.

(10) Patent No.: US 12,729,553 B2
(45) Date of Patent: Sep. 8, 2026

(54) SPA SHELL FOR A SPA HAVING THERMALLY INSULATED SECTIONS

(71) Applicant: Masterspas, LLC, Fort Wayne, IN (US)

(72) Inventors: Nathan Coelho, Leo, IN (US); Melanie Harris, Fort Wayne, IN (US); Nathaniel Kipfer, Fort Wayne, IN (US)

(73) Assignee: Masterspas, LLC, Fort Wayne, IN (US)

( * ) Notice: Subject to any disclaimer, the term of this patent is extended or adjusted under 35 U.S.C. 154(b) by 100 days.

(21) Appl. No.: 18/812,292

(22) Filed: Aug. 22, 2024

(65) Prior Publication Data

US 2025/0067071 A1 Feb. 27, 2025

Related U.S. Application Data

(60) Provisional application No. 63/623,567, filed on Jan. 22, 2024, provisional application No. 63/534,064, filed on Aug. 22, 2023.

(51) Int. Cl.
*E04H 4/00* (2006.01)
*E04H 4/12* (2006.01)

(52) U.S. Cl.
CPC ..... *E04H 4/0037* (2013.01); *E04H 4/129* (2013.01)

(58) Field of Classification Search
CPC ..... A61H 33/02; A61H 33/0087; A61H 33/6005; E04H 4/14; E04H 4/0037; A47K 3/001; A47K 3/002
See application file for complete search history.

(56) References Cited

U.S. PATENT DOCUMENTS 3,272,201 A 9/1966 Burns
4,047,522 A 9/1977 Plugge
(Continued)

FOREIGN PATENT DOCUMENTS

CH 142811 12/2016
CH 144455 2/2019
(Continued)

OTHER PUBLICATIONS

Alpine Terrain—Master Spas, LLC, posted date unavailable [retrieved online Jul. 8, 2025], Retrieved from internet, https://chillygoattubs.com/collections/cold-tubs-new/products/alpine-terrain-cold-tub (Year: 2025).

(Continued)

*Primary Examiner* — Erin Deery
(74) *Attorney, Agent, or Firm* — Kaplan Breyer Schwarz, LLP

(57) ABSTRACT

A spa shell for a spa includes a water holding compartment operative as a cold tub. The water holding compartment includes a floor wall, an equipment sidewall, and a floor connecting wall connecting the floor wall with the equipment sidewall. A non-slip laminate of thermally insulative material disposed on an exterior surface of each of the equipment sidewall and the floor connecting wall. A top deck wall extends from the water holding compartment toward an end of the spa shell. A non-slip laminate of thermally insulative material is disposed on an exterior surface of the top deck wall. The non-slip laminates of thermal insulative material thermally isolates the exterior surface of each of the equipment sidewall, the floor connecting wall, and the top deck wall. In some embodiments the spa shell further includes a second water holding compartment that is operative as a hot tub.

30 Claims, 13 Drawing Sheets

(56) References Cited

U.S. PATENT DOCUMENTS

| | | | | |
|---|---|---|---|---|
| 4,149,529 | A | 4/1979 | Copeland et al. | |
| 4,621,613 | A | 11/1986 | Krumhansl | |
| 4,667,479 | A | 5/1987 | Doctor | |
| 4,761,838 | A * | 8/1988 | Hargrove | A61H 33/0095 4/514 |
| 4,985,941 | A | 1/1991 | Pommerening | |
| 5,241,958 | A | 9/1993 | Noeldner | |
| 5,287,567 | A | 2/1994 | Eash et al. | |
| 5,345,621 | A * | 9/1994 | Livingston | A47K 3/02 4/584 |
| 5,509,274 | A | 4/1996 | Lackstrom | |
| 5,794,280 | A * | 8/1998 | Hansen | A61H 33/0087 165/47 |
| 5,809,796 | A | 9/1998 | Zakryk | |
| 5,809,942 | A | 9/1998 | Kralovec et al. | |
| 6,227,003 | B1 | 5/2001 | Smolinsky | |
| 6,553,584 | B1 | 4/2003 | Elnar | |
| 7,712,161 | B2 | 5/2010 | Reynolds | |
| D642,663 | S | 8/2011 | Dosne | |
| 8,214,936 | B2 | 7/2012 | Thweatt, Jr. | |
| 8,393,019 | B1 | 3/2013 | Cavuoti | |
| D683,468 | S | 5/2013 | Gill | |
| 8,453,275 | B2 | 6/2013 | May et al. | |
| 8,572,769 | B2 | 11/2013 | Gamracy et al. | |
| D703,795 | S | 4/2014 | Licini | |
| 9,700,180 | B1 * | 7/2017 | Zuravsky | A47K 3/122 |
| 9,938,740 | B1 * | 4/2018 | Nygard | A61H 33/6005 |
| 10,213,362 | B2 | 2/2019 | Moore et al. | |
| D903,066 | S | 11/2020 | Dominguez et al. | |
| D919,105 | S | 5/2021 | Kurganoff | |
| D919,823 | S | 5/2021 | Larsen et al. | |
| D1,047,089 | S | 10/2024 | Fraher et al. | |
| D1,066,705 | S | 3/2025 | Andersen et al. | |
| D1,076,124 | S | 5/2025 | Fischer et al. | |
| D1,087,368 | S | 8/2025 | Bachand | |
| D1,105,457 | S | 12/2025 | Baker et al. | |
| 2007/0079436 | A1 | 4/2007 | Na et al. | |
| 2007/0180607 | A1 | 8/2007 | Pickrell et al. | |
| 2007/0226890 | A1 | 10/2007 | Pflueger | |
| 2009/0255050 | A1 | 10/2009 | Lebrun et al. | |
| 2011/0000013 | A1 | 1/2011 | Elnar | |
| 2011/0072576 | A1 | 3/2011 | Brunelle et al. | |
| 2012/0084910 | A1 | 4/2012 | Murphy | |
| 2019/0070070 | A1 | 3/2019 | Mulcahy | |
| 2019/0330868 | A1 | 10/2019 | Sidhu et al. | |
| 2022/0136510 | A1 | 5/2022 | Pelletier et al. | |

FOREIGN PATENT DOCUMENTS

| | | | |
|---|---|---|---|
| CN | 111728849 | A | 10/2020 |
| CN | 309525511 | S | 9/2025 |
| CN | 309605518 | S | 11/2025 |
| EM | 008455802-0001 | | 6/2023 |
| EM | 015038971-0002 | | 11/2023 |
| EP | 015038971-00002 | | 10/2023 |
| JP | 2002-013838 | A | 1/2002 |
| WO | 20070138742 | A1 | 6/2007 |
| WO | 2012/051276 | A1 | 4/2012 |

OTHER PUBLICATIONS

Aqua Pro Pool & Spa, The Coast Freshe Cold Plunge, posted date unavailable [retrieved online Jul. 8, 2025], Retrieved from internet, https://aquapropoolspa.com/cold-plunge-coast-freshe/ (Year: 2025).

Icebound Essentials—The resolute Pro, posted date unavailable [retrieved online Jul. 8, 2025], Retrieved from internet, https://iceboundessentials.com/products/the-resolute-pro?srsltid=AfmBOorXKjCuBdYEED_Nr0GZECIZ8rFGfN9APxjdTI-mNiRhAec-O8W6 (Year: 2025).

Instagram—chillygoattubs: "GOATS don't just happen.", posted Sep. 7, 2023 [retrieved online Jul. 8, 2025], Retrieved from internet, https://www.instagram.com/p/Cw5UG_pudmV/ (Year: 2023).

List of references Mailed on Jul. 14, 2025 for U.S. Appl. No. 29/905,757, 2 page(s).

Non-Final Rejection Mailed on Jul. 14, 2025 for U.S. Appl. No. 29/905,757, 7 page(s).

YouTube—From pool to cool: Michael Phelps and Chilly GOAT Cold Tubs by Master Spas by Chilly GOAT Tubs, posted Jul. 12, 2023 [retrieved online Jul. 8, 2025], Retrieved from internet, https://www.youtube.com/watch?v=pqdpDFk0P4A (Year: 2023).

YouTube—Revolutionizing Wellness: The launch of the Michael Phelps Chilly GOAT Cold Tub by Master Spas by Chilly GOAT tubs, posted Jul. 12, 2023 [retrieved online Jul. 8, 2025], Retrieved from internet, https://www.youtube.com/watch?app=desktop&v=aZyW1aAh5YM (Year: 2023).

Nathan Coelho et al., Related Design U.S. Appl. No. 29/905,757 entitled "Cold Plunge Chiller Spa Shell Having Thermal Insulation Pads", Oct. 25, 2023, 54 pp.

Nathan Coelho et al., Related Design U.S. Appl. No. 29/928,336 entitled "Dual Temperature Spa Shell Having Thermal Insulation Pads", Feb. 9, 2024, 66 pp.

"Atera Spas Anytemp Model CTS8:35/44", ateraspas.com. Apr. 30, 2016. https://web.archive.org/web/20160430121845/https://www.ateraspas.com/n-cts.html.

"CoolZone Hot Tub Cooling System", calderaspas.com. Accessed: Nov. 29, 2022. https://www.calderaspas.com/hot-tub-accessories/cold-water-hot-tub.

"Chiller Tubs and Cold Plunge Pools", cedartubs.com. May 15, 2013. https://web.archive.org/web/20130515044005/https://www.cedartubs.com/chiller-tub.html.

Marquis, "Enjoy Your Marquis Hot Tub During Hot Summer Months", blog.marquisspas.com. Accessed Nov. 29, 2022. Maintenance, Jul. 10, 2018. https://blog.marquisspas.com/maintenance/enjoy-your-marquis-hot-tub-during-hot-summer-months/.

Nathan Coelho et al., Related Design U.S. Appl. No. 29/961,148 entitled "Thermal Insulation Pad for a Spa Shell", filed Sep. 4, 2024, 33 pp.

Nathan Coelho et al., Related Design U.S. Appl. No. 29/961,202 entitled "Thermal Insulation Pad for a Spa Shell", filed Sep. 4, 2024, 13 pp.

Notice of Allowance and Fees Due (PTOL-85) Mailed on Mar. 3, 2026 for U.S. Appl. No. 29/905,757, 2 page(s).

Notice of Allowance and Fees Due (PTOL-85) Mailed on Dec. 16, 2025 for U.S. Appl. No. 29/905,757, 7 page(s).

Ex Parte Quayle Action Mailed on Jan. 27, 2026 for U.S. Appl. No. 29/928,336, 4 page(s).

Home—Cold Plunge | Aquavoss: Hot and Cold Water Therapy, posted date unavailable [retrieved online Jan. 15, 2026]. Retrieved from internet, https://aquavoss.com (Year: 2026).

Iceland Duo 2-in-1 Hot & Cold Plunge Tub | Weills Spa, posted date unavailable [retrieved online Jan. 15, 2026]. Retrieved from internet, https://epichottubs.com/shop/cold-plunge/iceland-duo/ (Year: 2026).

Iceland Duo Cold Plunge & Hot Tub | Johnsons Wellness, posted date unavailable [retrieved online Jan. 15, 2026]. Retrieved from internet, https://www.johnsonswellness.com/shop/hot-tubs-cold-tubs-swim-spas/cold-plunge-tubs/iceland-duo-cold-plunge-ice-bath-hot-tub/ (Year: 2026).

List of references Mailed on Jan. 27, 2026 for U.S. Appl. No. 29/928,336, 2 page(s).

Valaris Glacier: Hot Tub + Cold Tub—Master Spas, LLC, posted date unavailable [retrieved online Jan. 15, 2026]. Retrieved from internet, https://chillygoattubs.com/products/valaris-glacier?srsltid=AfmBOorjJsyY1Kx1v9tUIQGdUbM2xL5jSzqXaT_N_86d2d2cf4QzLf1X (Year: 2026).

XTREME DUAL™ Outdoor Contrast System, posted date unavailable [retrieved online Jan. 15, 2026]. Retrieved from internet, https://coldture.com/en-us/products/xtreme-outdoor-contrast-system (Year: 2026).

Notice of Allowance and Fees Due (PTOL-85) Mailed on Apr. 7, 2026 for U.S. Appl. No. 29/928,336, 7 page(s).

Notice of Allowance mailed in U.S. Appl. No. 29/928,336, filed Apr. 21, 2026, 2 pp.

* cited by examiner

SPA SHELL FOR A SPA HAVING THERMALLY INSULATED SECTIONS

RELATED APPLICATIONS

This application claims the benefit under 35 U.S.C. 119(e) of U.S. Provisional patent application Ser. No. 63/534,064 filed Aug. 22, 2023 and U.S. Provisional Patent application Ser. No. 63/623,567 filed Jan. 22, 2024, the entire disclosures of which are incorporated herein by reference.

FIELD

The present disclosure relates to spas. More particularly, the present disclosure relates to a spa shell for a spa having non-slip laminates of thermal insulative material disposed on exterior surfaces thereof.

BACKGROUND

Spas are often used to help lessen aches and pains, improve circulation, relieve arthritis, relieve stress, help with stiffness, sciatica, etc. More particularly, cold water immersion helps an individual to cool down and reduce muscle inflammation after working out, playing sports, or exercising. Hot water immersion promotes relaxation, pain relief, and/or the like.

Most spas include a spa shell supported on a frame. A spa cabinet is typically provided to enclose the frame and other components of the spa including a water circulation-temperature system. Some water circulation-temperature systems use a heat pump to cool or heat the water contained in the water holding compartment of the spa shell, which defines the cold tub and/or hot tub. The heat pump is typically mounted adjacent to one or more walls of the water holding compartment of the spa shell. When the heat pump is operating in a water-cooling mode it generates heat that heats the air inside the spa cabinet. The heated air heats up the adjacent one or more walls of the water holding compartment. The heat generated in the adjacent one or more walls of the water holding compartment transfers into the cooled water contained in the water holding compartment, thereby undesirably raising the temperature of the water. Similarly, when the heat pump is operating in a water-heating mode, it absorbs heat from the air, which cools the air inside the spa cabinet. The cooled air cools the adjacent one or more walls of the water holding compartment. The cooled/cold one or more walls of the water holding compartment then absorb heat from the heated water contained in the water holding compartment, thereby undesirably lowering the temperature of the water.

Therefore, a spa shell is needed, which overcomes the above-noted thermal problems due to the operation of the heat pump.

SUMMARY

Disclosed herein is a spa shell for a spa. In various embodiments, the spa shell comprises: a water holding compartment that is operative as a cold tub, the water holding compartment defining a seating area, the water holding compartment including: a floor wall; an equipment sidewall; and a floor connecting wall connecting the floor wall with the equipment sidewall; and a non-slip laminate of thermal insulative material disposed on an exterior surface of the equipment sidewall, the non-slip laminate of thermal insulative material for thermally isolating the exterior surface of the equipment sidewall.

In some embodiments, the spa shell further comprises a non-slip laminate of thermal insulative material disposed on an exterior surface of the floor connecting wall, the non-slip laminate of thermal insulative material for thermally isolating the exterior surface of the floor connecting wall.

In some embodiments, the spa shell further comprises a top deck wall extending from the water holding compartment toward an end of the spa shell.

In some embodiments, the spa shell further comprises a non-slip laminate of thermal insulative material disposed on an exterior surface of the top deck wall, the non-slip laminate of thermal insulative material for thermally isolating the exterior surface of the top deck wall.

In some embodiments, the spa shell further comprises a non-slip laminate disposed on an exterior surface of the floor wall.

In some embodiments of the spa shell, the water holding compartment further includes a backrest sidewall and a seat-wall, the backrest sidewall and the seat-wall forming the seating area.

In some embodiments of the spa shell, the water holding compartment further includes a lateral sidewall, the lateral sidewall including a bumped-out area protruding into the seating area and thereby defining an armrest.

In some embodiments, the spa shell further comprises a non-slip laminate disposed on an exterior surface of the armrest.

In some embodiments, the spa shell further comprises a second water holding compartment that is operative as a hot tub, the second water holding compartment defining a seating area, the second water holding compartment including a floor wall and a non-slip laminate disposed on an exterior surface of the floor wall.

In some embodiments of the spa shell, the second water holding compartment further includes a backrest sidewall and a seat-wall, the backrest sidewall and the seat-wall forming the seating area.

In some embodiments of the spa shell, the second water holding compartment further includes a lateral sidewall, the lateral sidewall including a bumped-out area protruding into the seating area of the second water holding compartment and thereby defining an armrest.

In some embodiments, the spa shell further comprises a non-slip laminate disposed on an exterior surface of the armrest defined by the bumped-out area protruding into the seating area of the second water holding compartment.

In some embodiments, the spa shell further comprises a separation top wall that extends parallel with and separates the water compartment that is operative as the cold tub from the second water compartment that is operative as the hot tub.

In some embodiments, the spa shell further comprises a non-slip laminate disposed on an exterior surface of the separation top wall.

In some embodiments of the spa shell, the non-slip laminate of thermal insulative material comprises at least one layer of Polyethylene (PE) foam or Ethylene Vinyl Acetate (EVA) foam.

Also disclosed herein is a spa comprising: a spa shell having a water holding compartment that is operative as a cold tub, the water holding compartment defining a seating area, the water holding compartment including: a floor wall; an equipment sidewall; and a floor connecting wall connecting the floor wall with the equipment sidewall; a heat pump located opposite an interior surface of the equipment side wall; and a non-slip laminate of thermal insulative material disposed on an exterior surface of the equipment sidewall, the non-slip laminate of thermal insulative material for thermally isolating the exterior surface of the equipment sidewall from hot and/or cold air generated by the heat pump and the heat pump itself.

In some embodiments of the spa, the heat pump is also located opposite an interior surface of the floor connecting wall and further comprising a non-slip laminate of thermal insulative material disposed on an exterior surface of the floor connecting wall, the non-slip laminate of thermal insulative material for thermally isolating the exterior surface of the floor connecting wall from hot and/or cold air generated by the heat pump and the heat pump itself.

In some embodiments, the spa further comprises a top deck wall extending from the water holding compartment of the cold tub toward an end of the spa shell.

In some embodiments of the spa, the heat pump is also located opposite an interior surface of the top deck wall and further comprises a non-slip laminate of thermal insulative material disposed on an exterior surface of the top deck wall of the spa shell, the non-slip laminate of thermal insulative material for thermally isolating the exterior surface of the top deck wall from hot and/or cold air generated by the heat pump and the heat pump itself.

In some embodiments, the spa further comprises a non-slip laminate disposed on an exterior surface of the floor wall of the spa shell.

In some embodiments of the spa, the water holding compartment of the spa shell further includes a backrest sidewall and a seat-wall, the backrest sidewall and the seat-wall forming the seating area.

In some embodiments of the spa, the water holding compartment of the spa shell further includes a lateral sidewall, the lateral sidewall including a bumped-out area protruding into the seating area and thereby defining an armrest.

In some embodiments, the spa further comprises a non-slip laminate disposed on an exterior surface of the armrest of the spa shell.

In some embodiments of the spa, the spa shell further comprises a second water holding compartment that is operative as a hot tub, the second water holding compartment defining a seating area, the second water holding compartment including a floor wall and a non-slip laminate disposed on an exterior surface of the floor wall.

In some embodiments of the spa, the second water holding compartment of the spa shell further includes a backrest sidewall and a seat-wall, the backrest sidewall and the seat-wall forming the seating area.

In some embodiments of the spa, the second water holding compartment of the spa shell further includes a lateral sidewall, the lateral sidewall including a bumped-out area protruding into the seating area of the second water holding compartment and thereby defining an armrest.

In some embodiments, the spa further comprises a non-slip laminate disposed on an exterior surface of the armrest of the spa shell defined by the bumped-out area protruding into the seating area of the second water holding compartment of the spa shell.

In some embodiments of the spa, the spa shell further comprises a separation top wall that extends parallel with and separates the water compartment that is operative as the cold tub from the second water compartment that is operative as the hot tub.

In some embodiments, the spa further comprises a non-slip laminate disposed on an exterior surface of the separation top wall of the spa shell.

In some embodiments of the spa, the non-slip laminate of thermal insulative material comprises at least one layer of Polyethylene (PE) foam or Ethylene Vinyl Acetate (EVA) foam.

DETAILED DESCRIPTION

It should be understood that the phraseology and terminology used below for the purpose of description and should not be regarded as limiting. The use herein of the terms "comprising," "including," "having," "containing," and variations thereof are meant to encompass the structures and features recited thereafter and equivalents thereof as well as additional structures and features. Unless specified or limited otherwise, the terms "attached," "mounted," "affixed,"

"connected," "supported," "coupled," and variations thereof are used broadly and encompass both direct and indirect forms of the same.

Figure 1:
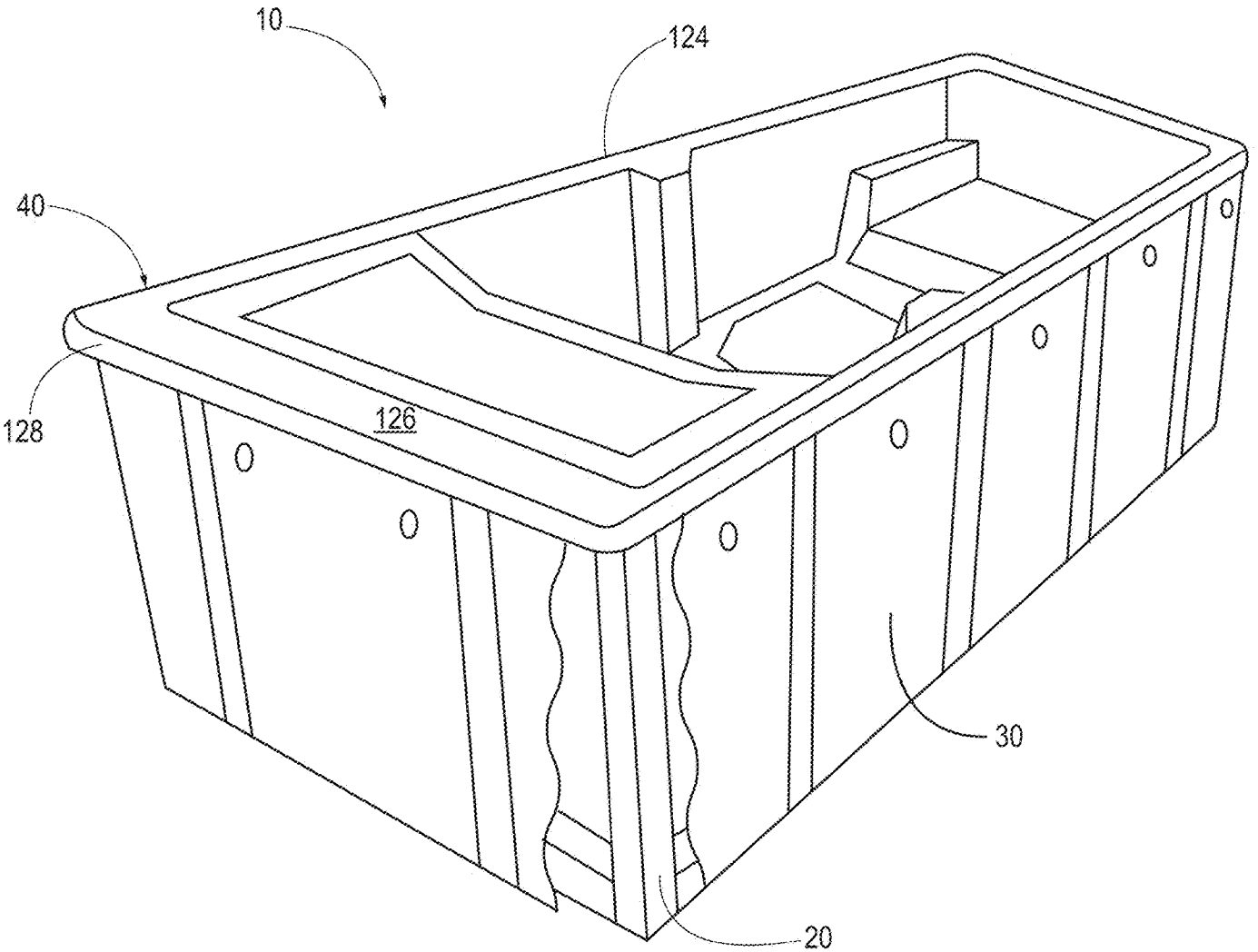
FIG. 1 is a perspective view of a spa 10 comprising a spa shell 40 having thermally insulated sections, according to an illustrative embodiment of the present disclosure.
Figure 5A:
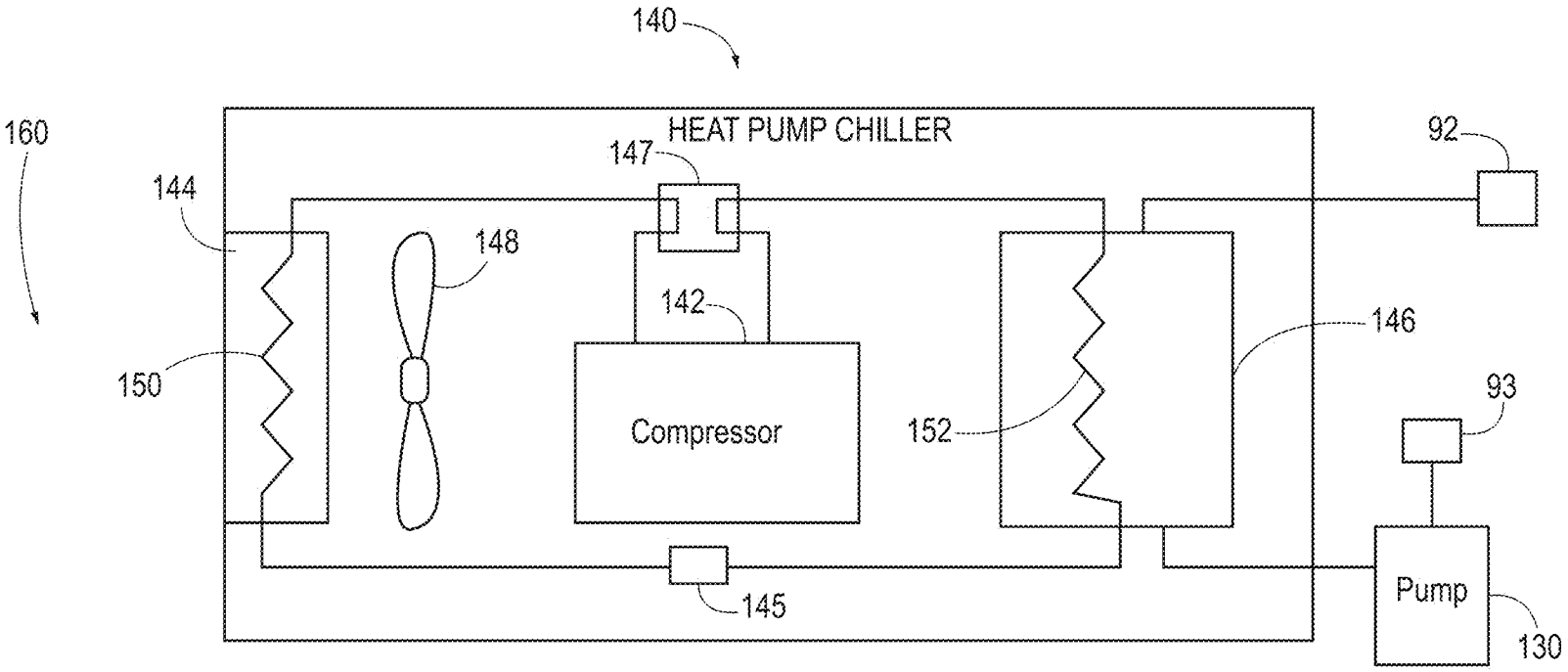
FIG. 5A is a block diagram of the heat pump chiller according to an illustrative embodiment of the present disclosure.
Figure 5B:
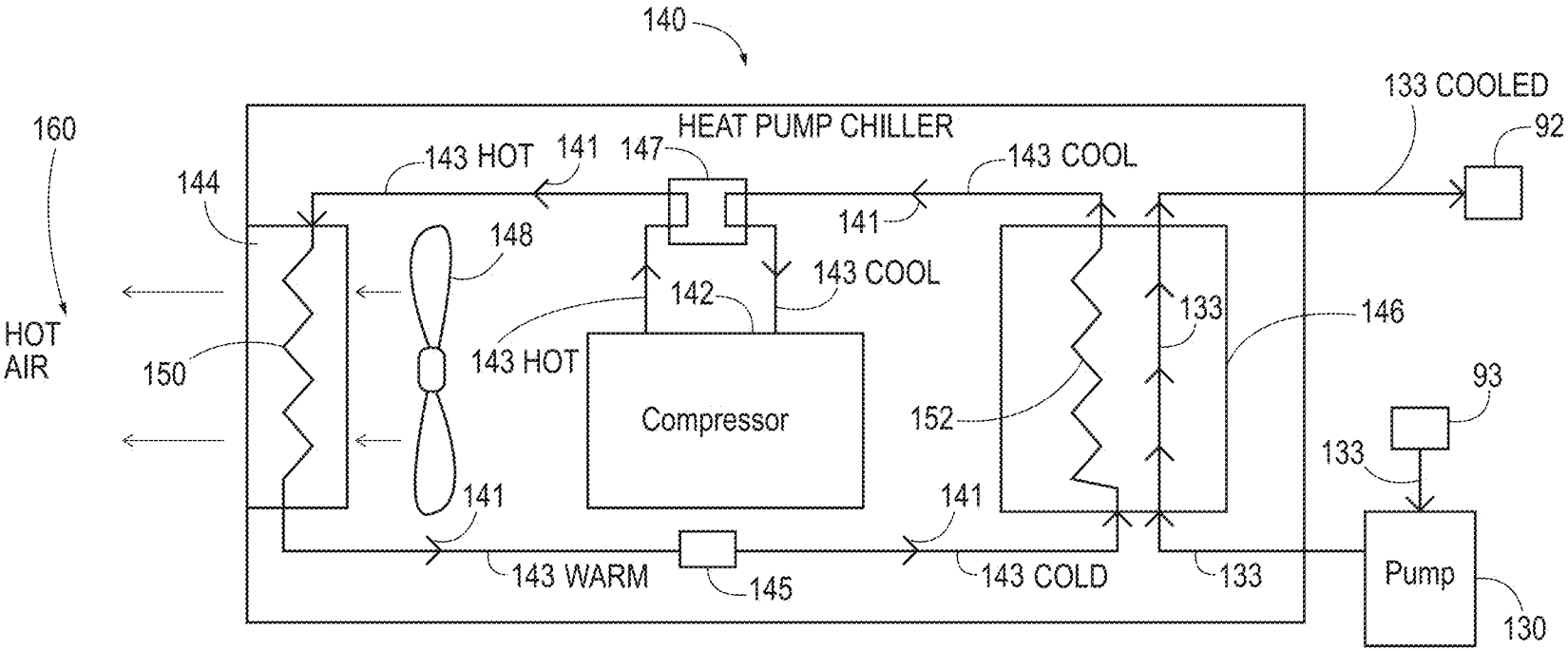
FIG. 5B is a block diagram of the heat pump chiller of FIG. 5A illustrating the operation of the heat pump chiller when it is operating in a cooling mode to cool water contained in a water holding compartment of a spa shell, according to an illustrative embodiment of the present disclosure.
Figure 5C:
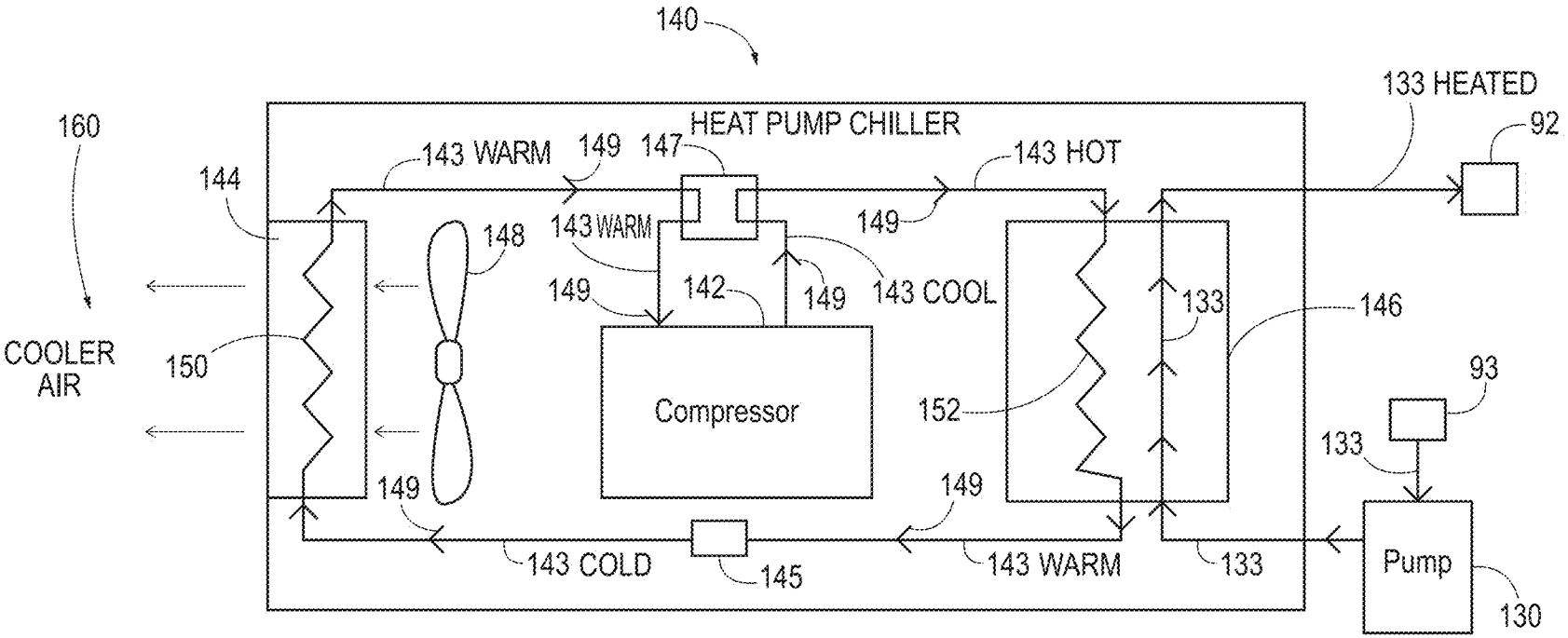
FIG. 5C is a block diagram of the heat pump chiller of FIG. 5A illustrating the operation of the heat pump chiller when it is operating in a heating mode to heat water contained in a water holding compartment of a spa shell, according to an illustrative embodiment of the present disclosure.

FIG. 1 is a perspective view of a spa 10 comprising a spa shell 40 having thermally insulated sections, according to an illustrative embodiment of the present disclosure. The spa shell 40 of the spa 10 is constructed to provide a cold plunge chiller spa for cold water immersion and/or to cool down and reduce muscle inflammation after working out, playing sports, and/or exercising. As shown in FIG. 1, the spa shell 40 is typically mounted in a frame 20 that supports the spa shell 40. A spa cabinet 30 is typically provided to enclose the frame 20 and other components of the spa 10 including but not limited to a water circulation-temperature system (FIGS. 5A-5C).

Figure 2:
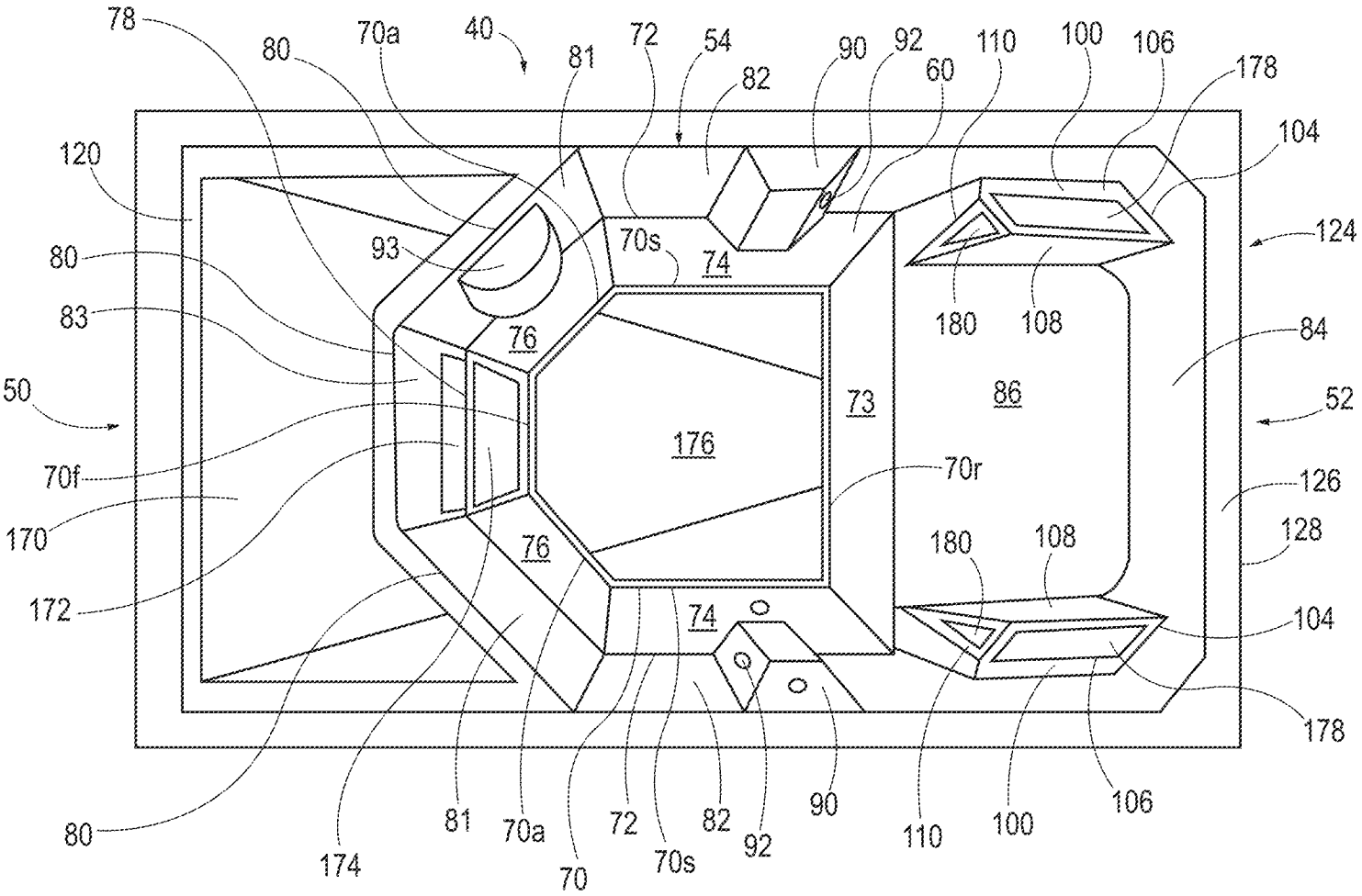
FIG. 2 is a top view of the spa shell of the spa of FIG. 1, according to an illustrative embodiment of the present disclosure.

FIG. 2 is a top view of the spa shell 40 of the spa 10 of FIG. 1, according to an illustrative embodiment of the present disclosure. The spa shell 40 has a first end 50, a second end 52 opposite the first end 50, and a cold tub 54 disposed between the first end 50 and the second end 52. The cold tub 54 comprises a water holding compartment 60 formed by a floor wall 70, an irregular-shaped annular floor connecting wall 72, an equipment sidewall 80, lateral sidewalls 82, a backrest sidewall 84, and a seat-wall 86. The annular floor connecting wall 72 comprises a rear connecting wall section 73, opposing lateral connecting wall sections 74, front corner connecting wall sections 76, and a front central connecting wall section 78. The equipment sidewall 80 comprises a first and second corner sidewalls 81 connected by a central sidewall 83. The rear connecting wall section 73 connects a rear edge 70R of the floor wall 70 to the seat-wall 86. The front corner connecting wall sections 76 connect angled front edges 70A of the floor wall 70 to the first and second corner sidewalls 81 of the equipment wall 80. The front central connecting wall section 78 connects a front leading edge 70F of the floor wall 70 to the central sidewall 83 of the equipment wall 80. The lateral connecting wall sections 74 connect side edges 70S of the floor wall 70 to the lateral side walls 82. A skimmer 93 is positioned in one of the corner sidewalls 81. Each lateral sidewall 82 includes a first bumped-out area 90 that protrudes into a floor area of the water holding compartment 60 and houses a water circulation/return 92, and a second bumped-out area 100 that protrudes into a seating area of the water holding compartment 60 and forms an armrest 104. The water circulation/returns 92 housed in the first bumped-out areas 90 are pointed in substantially opposite directions to create a whirlpool effect in the water, which prevents heat buildup on the surface of the user's skin. Each armrest 104 formed by the second bump-out areas 100 includes a top wall 106, a sidewall 108, and an upwardly facing angled front wall 110. The spa shell 40 further comprises a top deck wall 120 that extends from the equipment sidewall 80 toward the first end 50 of the spa shell 40. The spa shell 40 further comprises a rim 124 that extends about the periphery of the spa shell 40. The rim 124 is formed by an outwardly extending horizontal shoulder 126 and a downwardly extending sidewall 128. The rim 124 of the spa shell 40 is seated on horizontally extending top members (not shown) of the frame 20 of the spa 10 when the spa shell 40 and frame 20 are assembled together. In various embodiments, the spa shell 40 can be made of an acrylic material and a High-density polyethylene (HDPE) material or any suitable polymeric, composite, or metallic material.

Referring still to FIG. 2, a non-slip laminate of hot and cold insulative material is adhered to the exterior facing surface of each of the top deck wall 120 (non-slip laminate 170), the central sidewall 83 of the equipment sidewall 80 (non-slip laminate 172), the front central connecting wall section 78 of the annular floor connecting wall 72 (non-slip laminate 174), the floor wall 70 (non-slip laminate 176), the top wall 106 of the armrest 104 (non-slip laminate 178), and the angled front wall 110 of the armrest 104 (non-slip laminate 180). The non-slip laminates 170, 172, 174, 176, 178, 180 allow a user to enter, exit, and move about the water holding compartment 60 of cold tub 54 in a safe manner without slipping on these surfaces.

Figure 3A:
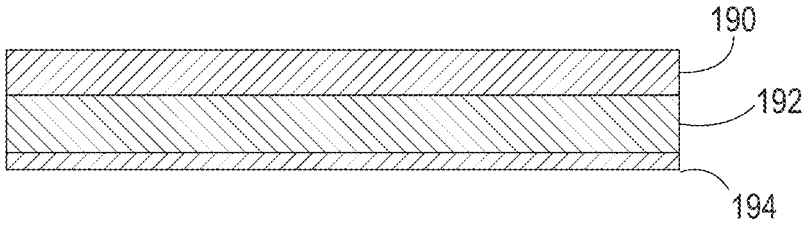
FIG. 3A is a sectional view of the hot and cold thermal insulative material used for non-slip laminates according to an illustrative embodiment of the present disclosure.
Figure 3B:
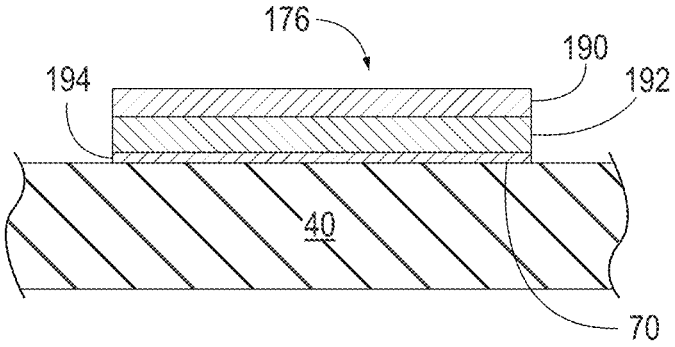
FIG. 3B is a sectional view showing the non-slip laminate attached to the floor wall of the spa shell, according to an illustrative embodiment of the present disclosure.

FIG. 3A is a sectional view of the hot and cold thermal insulative material used for the non-slip laminates 170, 172, 174, 176, 178, 180 according to an illustrative embodiment of the present disclosure. As shown in FIG. 3, the hot and cold insulative material of each of the non-slip laminates 170, 172, 174, 176, 178, 180 can comprise a first layer 190 of non-slip, thermal (hot and cold) insulative material, a second layer 192 of non-slip, thermal (hot and cold) insulative material disposed over the first layer 190 of non-slip, thermal (how and cold) insulative material, and a third layer 194 of adhesive disposed under the first layer 190 of non-slip, thermal (how and cold) insulative material for adhesively attaching each of the non-slip laminates 170, 172, 174, 176, 178, 180 to an exterior surface of the spa shell 40. FIG. 3B is a sectional view showing the non-slip laminate 176 attached to the floor wall 70 of the spa shell 40. In some embodiments, the first and second layers 190 and 192 of non-slip, thermal (hot and cold) insulative material can each comprise a UV-resistant closed cell foam material, such as Polyethylene (PE) foam or Ethylene Vinyl Acetate (EVA) foam. In one illustrative embodiment, the first and second layers 190 and 192 of non-slip, thermal (hot and cold) insulative material can each have a thickness of about 3.0 millimeters (mm), plus or minus 0.5 mm, which provides a total thickness of 6 mm, plus or minus 1 mm, and the third layer 194 of adhesive can comprise an acrylic-based pressure sensitive adhesive. In other embodiments, the non-slip laminates 170, 172, 174, 176, 178, 180 can have first, second, and/or third layers of other thicknesses, either thicker or thinner than described above. In still other embodiments, the non-slip laminates 170, 172, 174, 176, 178, 180 can have first, second, and third layers with thicknesses that differ from non-slip laminate to non-slip laminate. In still further embodiments, one or more of the non-slip laminates 170, 172, 174, 176, 178, 180 can have only one layer of non-slip, thermal (hot and cold) insulative material or more than two layers of non-slip, thermal (hot and cold) insulative material. In still further embodiments, the non-slip laminates 176, 178, 180 can be made of another type of non-slip material that does not have hot and cold thermal insulative properties.

Figure 4:
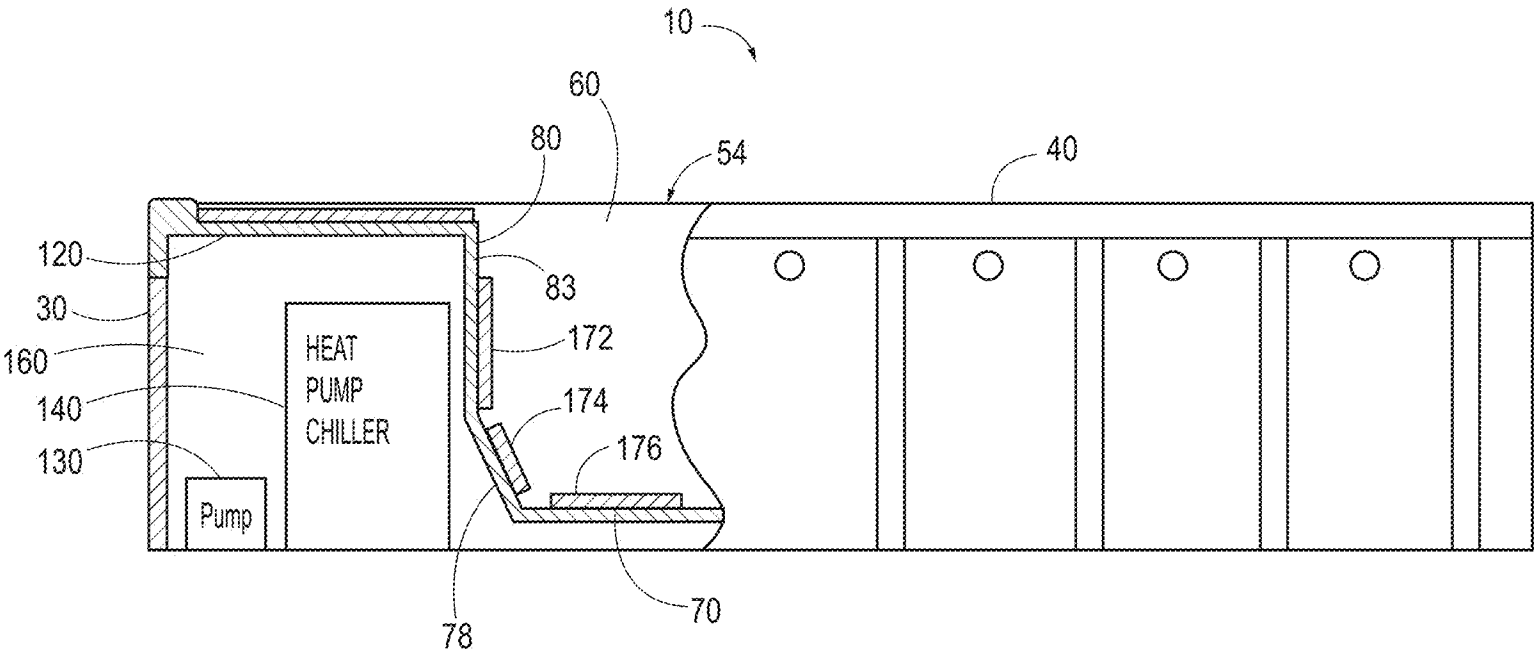
FIG. 4 is a side elevational view of the spa of FIG. 1 with a portion thereof in section illustrating an equipment space of the spa, according to an illustrative embodiment of the present disclosure.

Referring now to FIGS. 2 and 4, the water circulation-temperature system mentioned earlier, in one illustrative embodiment comprises and a water circulation pump 130, the water circulation/returns 92 located within the first bumped-out areas 90 of the water holding compartment 60, the skimmer 93, and associated plumbing (not shown). The water circulation pump 130 circulates water out of the water holding compartment 60 through the skimmer 93 (which operates as a filter and a drain for the water circulation pump 130), the plumbing and back into the water holding compartment 60 through the water circulation/returns 92. The circulation-temperature system further comprises a heat pump chiller 140 for heating, cooling or maintaining the temperature of the water contained in the water holding compartment 60. The heat pump chiller 140 and water circulation pump 130 are housed within the spa cabinet 30 in an equipment space 160 defined within the spa cabinet 30, underneath the top deck wall 120 of the spa shell 40, and next to the front central sidewall 83 of the equipment sidewall 80 and the front central connecting wall section 78 of the annular floor connecting wall 72 of the spa shell 40.

FIG. 5A is a block diagram of the heat pump chiller 140 according to an illustrative embodiment of the present disclosure. The heat pump chiller 140 can comprise a motor-driven refrigerant compressor 142, an evaporator 144, an expansion valve 145, a reversing valve 147, a fan 148, and a heat exchanger 146.

When the heat pump chiller 140 is set in a cooling mode to cool the water contained in the water holding compartment 60 of the cold tub 54, as illustrated in FIG. 5B, the reversing valve 147 is set so refrigerant flows through the evaporator 144, the heat exchanger 146 and the compressor 142 in a first direction, as indicated by arrows 141. Therefore, in the cooling mode, tub water 133 leaving the skimmer 93 moves through the heat exchanger 146 via the water circulation pump 130 and cold refrigerant $\mathbf{143}_{COLD}$ moves from the expansion valve 145 and enters a coil 152 inside of the heat exchanger 146. In the heat exchanger 146, heat in the water 133 transfers to the cold refrigerant $\mathbf{143}_{COLD}$ passing through the coil 152 of the heat exchanger 146, thereby cooling the water 133 as it passes therethrough. The cooled water $\mathbf{133}_{COOLED}$ exits the heat exchanger 146 and returns to the water holding compartment 60 (FIG. 2) via the water circulation/returns 92. The heat exchange process warms the refrigerant 143 such that cool refrigerant $\mathbf{143}_{COOL}$ exits the coil 152 of the heat exchanger 146 and flows through the reversing valve 147 into the compressor 142 where it is heated. Hot refrigerant $\mathbf{143}_{HOT}$ exits the compressor 142 and is directed by the reversing valve 147 into the evaporator 144. As the hot refrigerant $\mathbf{143}_{HOT}$ moves through a coil 150 of the evaporator 144, the fan 148 blows air 149 across it to transfer heat absorbed in the refrigerant $\mathbf{143}_{HOT}$ into the equipment space 160 defined within the spa cabinet 30, underneath the top deck wall 120 and next to the central sidewall 83 of the equipment wall 80 of the water holding compartment 60 and the front central connecting wall section 78 of the annular floor connecting wall 72 of the water holding compartment 60 (FIG. 4). Warm refrigerant $\mathbf{143}_{WARM}$, therefore, exits the coil 150 of the evaporator 144 and moves to the expansion valve 145.

The non-slip thermal insulating laminates 170, 172 and 174 adhered to the exterior surfaces of the top deck wall 120, the central sidewall 83 of the equipment wall 80 and the front central connecting wall section 78 of the annular floor connecting wall 72 of the water holding compartment 60 of the spa shell 40, are operative for preventing the heat in the hot air generated in the equipment space 160 (FIG. 4) by the evaporator 144 of the heat pump chiller 140 when the heat pump chiller 140 is set in the cooling mode (FIG. 5B), from being transferred into the cooled water $\mathbf{133}_{COOLED}$ contained in the water holding compartment 60 of the spa shell 40, by the central sidewall 83 and the front central connecting wall section 78 of the water holding compartment 60. If no non-slip thermal insulating laminates 170, 172, and 174 were provided on the exterior surfaces of the top deck wall 120, the central sidewall 83, and the front central connecting wall section 78, respectively, the heat in the hot air of the equipment space 160 could be easily transferred into the cooled water $\mathbf{133}_{COOLED}$ contained in the water holding compartment 60 of the spa shell 40, thereby undesirably raising the temperature of the water contained in the water holding compartment 60 during the operation of the heat chiller pump 140 in the cooling mode.

When the heat pump chiller 140 is set in a heating mode, as illustrated in FIG. 5C, the reversing valve 147 is set so refrigerant flows through the evaporator 144, the heat exchanger 146 and the compressor 142 in a second direction opposite the first direction 141 (FIG. 5B), as indicated by arrows 149. Therefore, in the heating mode, tub water 133 leaving the skimmer 93 moves through the heat exchanger 146 via the water circulation pump 130 and cold refrigerant $\mathbf{143}_{COLD}$ moves from the expansion valve 145 and enters the coil 150 of the evaporator 144. In the coil 150 of the evaporator 144, the cold refrigerant $\mathbf{143}_{COLD}$ absorbs the heat in the air as the fan 148 draws it in across the evaporator 144 from the equipment space 160, which warms the refrigerant 143. Warm refrigerant $\mathbf{143}_{WARM}$ exits the coil 150 of the evaporator 144 and flows through the reversing valve 147 into the compressor 142 where it is heated. Hot refrigerant $\mathbf{143}_{HOT}$ exits the compressor 142 and is directed by the reversing valve 147 into the coil 152 of the heat exchanger 146. As the hot refrigerant $\mathbf{143}_{HOT}$ moves through the coil 152 of the heat exchanger 146, the heat absorbed by the hot refrigerant $\mathbf{143}_{HOT}$ is transferred to tub water 133 passing through the heat exchanger 146. The heated tub water $\mathbf{133}_{HEATED}$ exiting the heat exchanger 146 returns to the water holding compartment 60 (FIG. 2) via the water circulation/returns 92. The hot refrigerant $\mathbf{143}_{HOT}$ is cooled by the heat transfer process in the heat exchanger 146, therefore, warm refrigerant $\mathbf{143}_{WARM}$ exits the coil 152 of the heat exchanger 146 and moves to the expansion valve 145.

The cold air generated in the equipment space 160 by the operation of the evaporator 144, when the heat pump chiller 140 is set in the heating mode (FIG. 5C), lowers the temperature of the top deck wall 120, the central sidewall 83 and front central connecting wall section 78 of the water holding compartment 60 of the spa shell 40. The non-slip thermal insulating laminates 170, 172, 174 adhered to the exterior surfaces of the top deck wall 120, the central sidewall 83, and the front central connecting wall section 78, respectively, are operative for preventing the top deck wall 120, the central sidewall 83 and the cold front central connecting wall section 78, which have been cooled by cold air in the equipment space 160 (FIG. 4), from absorbing heat out of the heated water $\mathbf{133}_{HEATED}$ contained in the water holding compartment 60 of the spa shell 40. If no non-slip thermal insulating laminates 170, 172, and 174 were provided on the exterior surfaces of the top deck wall 120, the central sidewall 83 and the front central connecting wall section 78, respectively, the cooled top deck wall 120, central sidewall 83 and front central connecting wall section 78 would be free to absorb the heat from the heated water $\mathbf{133}_{HEATED}$ contained in the water holding compartment 60 of the spa shell 40, thereby undesirably lowering the temperature of the water.

In addition, the area of the equipment space 160 must be open to provide proper air flow and ventilation. However, the equipment space 160 is limited in size and is difficult to insulate properly to deal with the hot or cold air generated in the equipment space by the operation of the evaporator 144. Providing the non-slip thermal insulating laminates 170, 172, and 174, on the exterior surfaces of the top deck wall 120, the central sidewall 83 of the equipment wall 80, and the front central connecting wall section 78 of the annular floor connecting wall 72, allows for proper air flow and ventilation in the equipment space 160.

Figure 6:
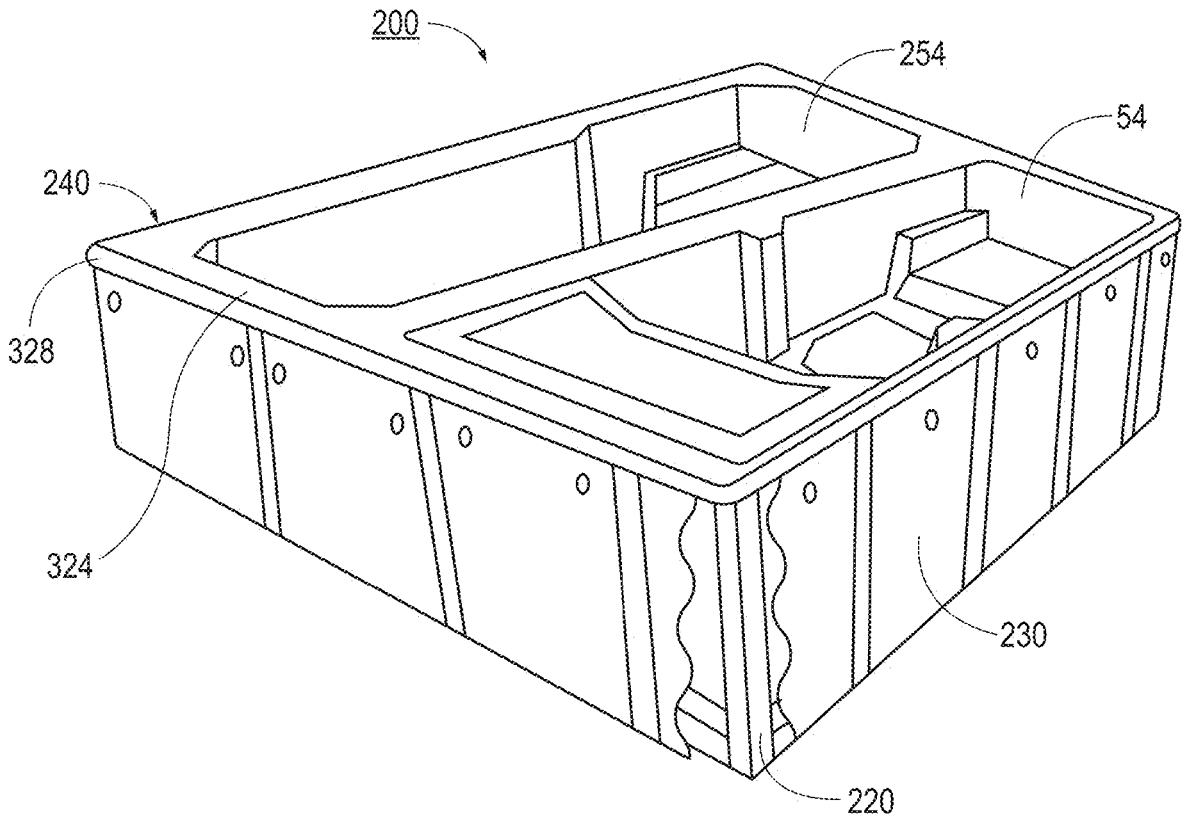
FIG. 6 is a perspective view of a spa comprising a spa shell having thermally insulated sections according to another illustrative embodiment of the present disclosure.

FIG. 6 is a perspective view of a spa 200 comprising a spa shell 240 having thermally insulated sections according to another illustrative embodiment of the present disclosure. The spa shell 240 of the spa 200 is constructed to provide a dual temperature spa comprising the cold tub 54 and the water circulation-temperature system described earlier with reference to FIGS. 1, 2, 3A, 3B, 4, and 5A-5C, and a hot tub 254. The cold tub 54 and hot tub 254 are arranged in a side-by-side manner for: 1) cold water immersion and/or to cool down and reduce muscle inflammation after working out, playing sports, or exercising; and 2) hot water immersion to promote relaxation, pain relief, and/or the like. As shown in FIG. 6, the spa shell 240 can be mounted in a frame 220 that supports the spa shell 240. A spa cabinet 230 encloses the frame 220 and other components of the spa 200 including but not limited to the cold water circulation-temperature system described earlier for the cold tub 54 referencing FIGS. 2, 4 and 5A-5C and a conventional hot tub circulation-temperature system (not shown) for the hot tub 254.

Figure 7A:
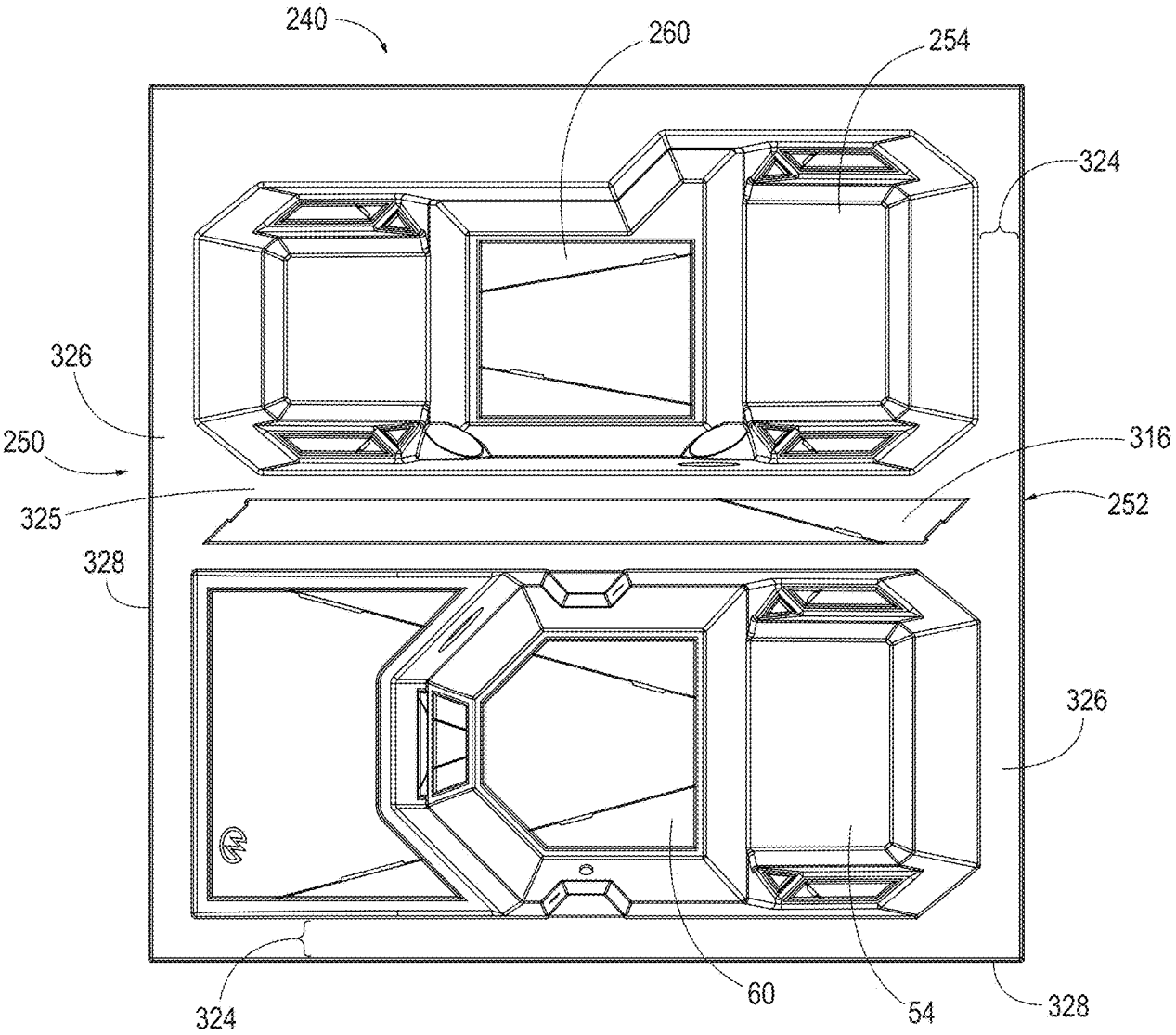
FIGS. 7A and 7D are top views of the spa shell of the spa of FIG. 6, according to illustrative embodiments of the present disclosure.

FIG. 7A is a top view of the spa shell 240 according to an illustrative embodiment of the present disclosure. The spa shell 240 has a first end 250, a second end 252 opposite the first end 250, and the cold and hot tubs 54 and 254 disposed between the first end 250 and the second end 252. The cold tub 54 comprises a cold water holding compartment 60 and the hot tub 254 comprises a water holding compartment 260. The water holding compartment 60 of the cold tub 54 and the water holding compartment 260 of the hot tub 254 are arranged in a side-by-side manner to allow a user to easily move between the cold tub 54 and the hot tub 254. The spa shell 240 further comprises a rim 324 that extends about the periphery of the spa shell 240. The rim 324 is formed by an outwardly extending horizontal shoulder 326 and a downwardly extending sidewall 328. The spa shell 240 further comprises a separation top wall 325 that extends parallel with and separates the cold tub 54 and the hot tub 254 from one another. The ends of the separation top wall 325 merge with the shoulder 326 of the rim 324 that extends about the periphery of the spa shell 240. The rim 324 of the spa shell 240 is seated on horizontally extending top members (not shown) of the frame 220 of the spa 200 when the spa shell 240 and frame 220 are assembled together. In various embodiments, the spa shell 240 can be made of an acrylic material and a High-density polyethylene (HDPE) material or any suitable polymeric, composite, or metallic material.

Figure 7B:
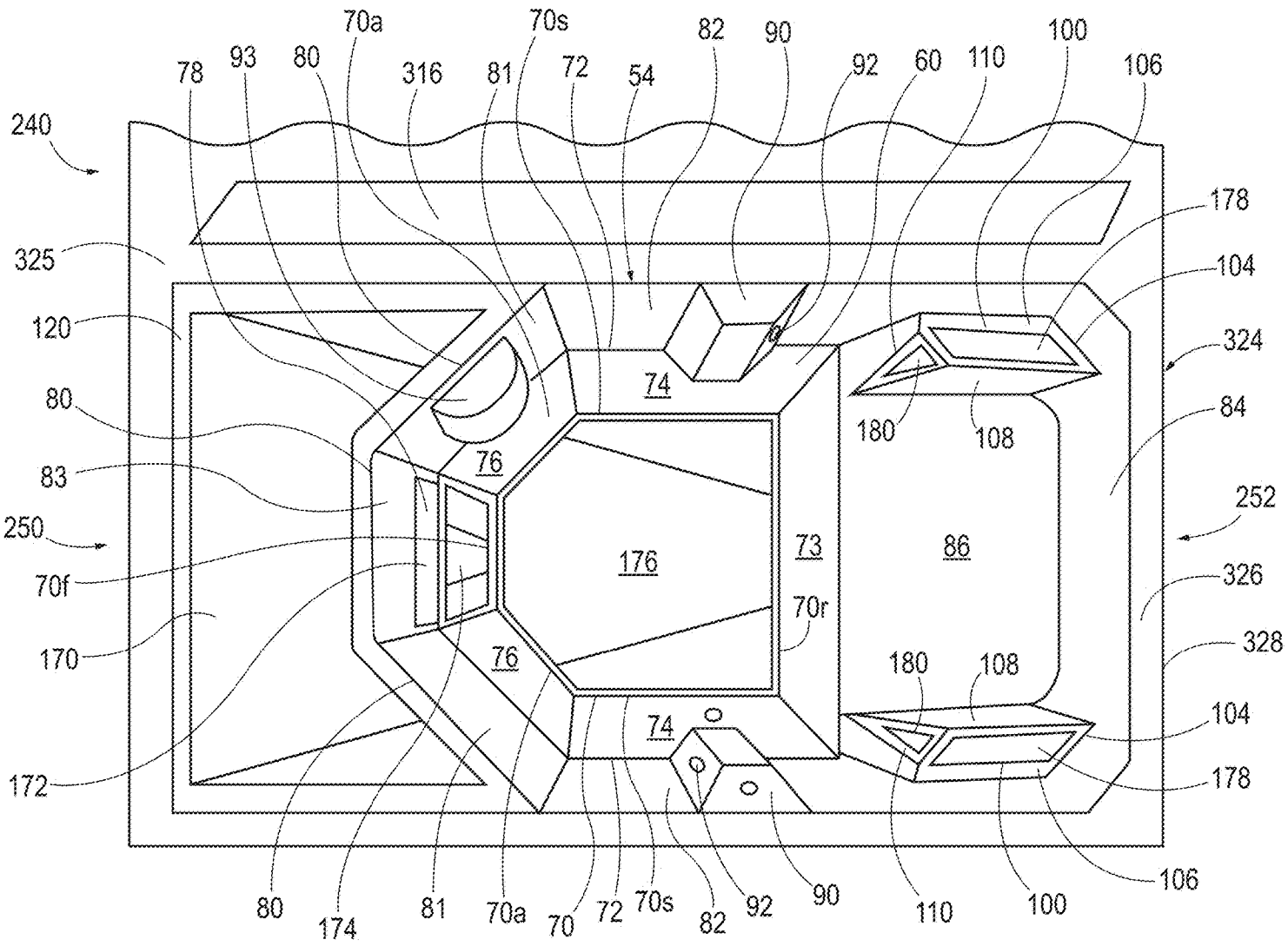
FIG. 7B is an enlarged top view of a cold tub of the spa shell illustrated in FIG. 7A.

FIG. 7B is an enlarged top view of the cold tub of the spa shell 240 illustrated in FIG. 7A. As illustrated, the water holding compartment 60 of the cold tub 54 is substantially identical to the holding compartment 60 described earlier with reference to FIG. 2 and therefore, is formed by a floor wall 70, an annular floor connecting wall 72, an equipment sidewall 80, lateral sidewalls 82, a backrest sidewall 84, and a seat-wall 86. The annular floor connecting wall 72 comprises a rear connecting wall section 73, opposing lateral connecting wall sections 74, front corner connecting wall sections 76, and a front central connecting wall section 78. The equipment sidewall 80 comprises a first and second corner sidewalls 81 connected by a central sidewall 83. The rear connecting wall section 73 connects a rear edge 70R of the floor wall 70 to the seat-wall 86. The front corner connecting wall sections 76 connect angled front edges 70A of the floor wall 70 to the first and second corner sidewalls 81 of the equipment wall 80. The front central connecting wall section 78 connects a front leading edge 70F of the floor wall 70 to the central sidewall 83 of the equipment wall 80. The lateral connecting wall sections 74 connect side edges 70S of the floor wall 70 to the lateral side walls 82. A skimmer 93 is positioned in one of corner sidewalls 81. Each lateral sidewall 82 includes a first bumped-out area 90 that protrudes into a floor area of the water holding compartment 60 and houses a water circulation/return 92, and a second bumped-out area 100 that protrudes into a seating area of the water holding compartment 60 and forms an armrest 104. The water circulation/returns 92 housed in the first bumped-out areas 90 are pointed in substantially opposite directions to create a whirlpool effect in the water, which prevents heat buildup on the surface of the user's skin. Each armrest 104 formed by the second bump-out areas 100 includes a top wall 106, a sidewall 108, and an upwardly facing angled front wall 110. A top deck wall 120 extends from the equipment sidewall 80 toward the first end 50 of the spa shell 40.

Figure 7C:
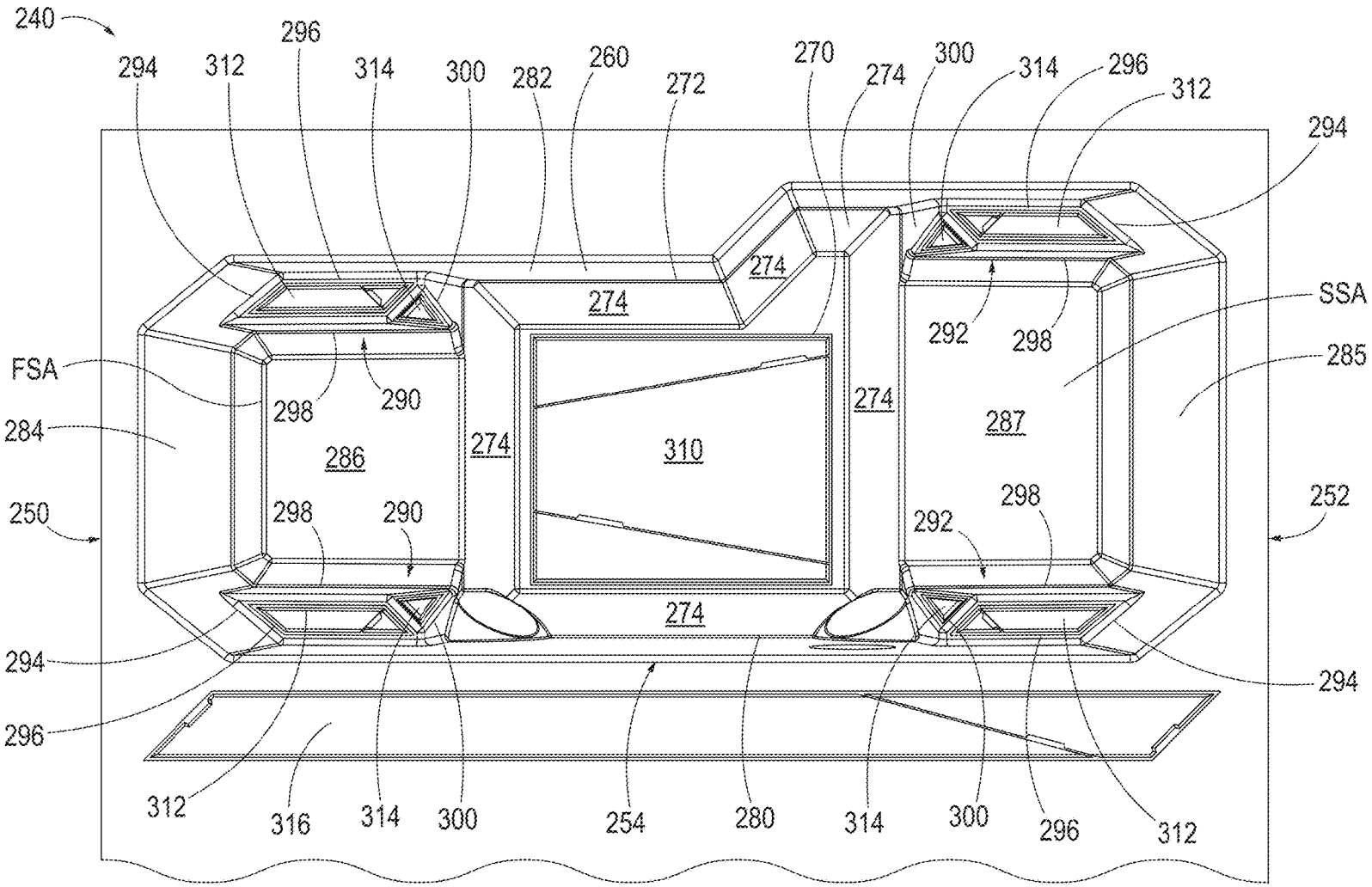
FIG. 7C is an enlarged top view of a hot tub of the spa shell illustrated in FIG. 7A.
Figure 7D:
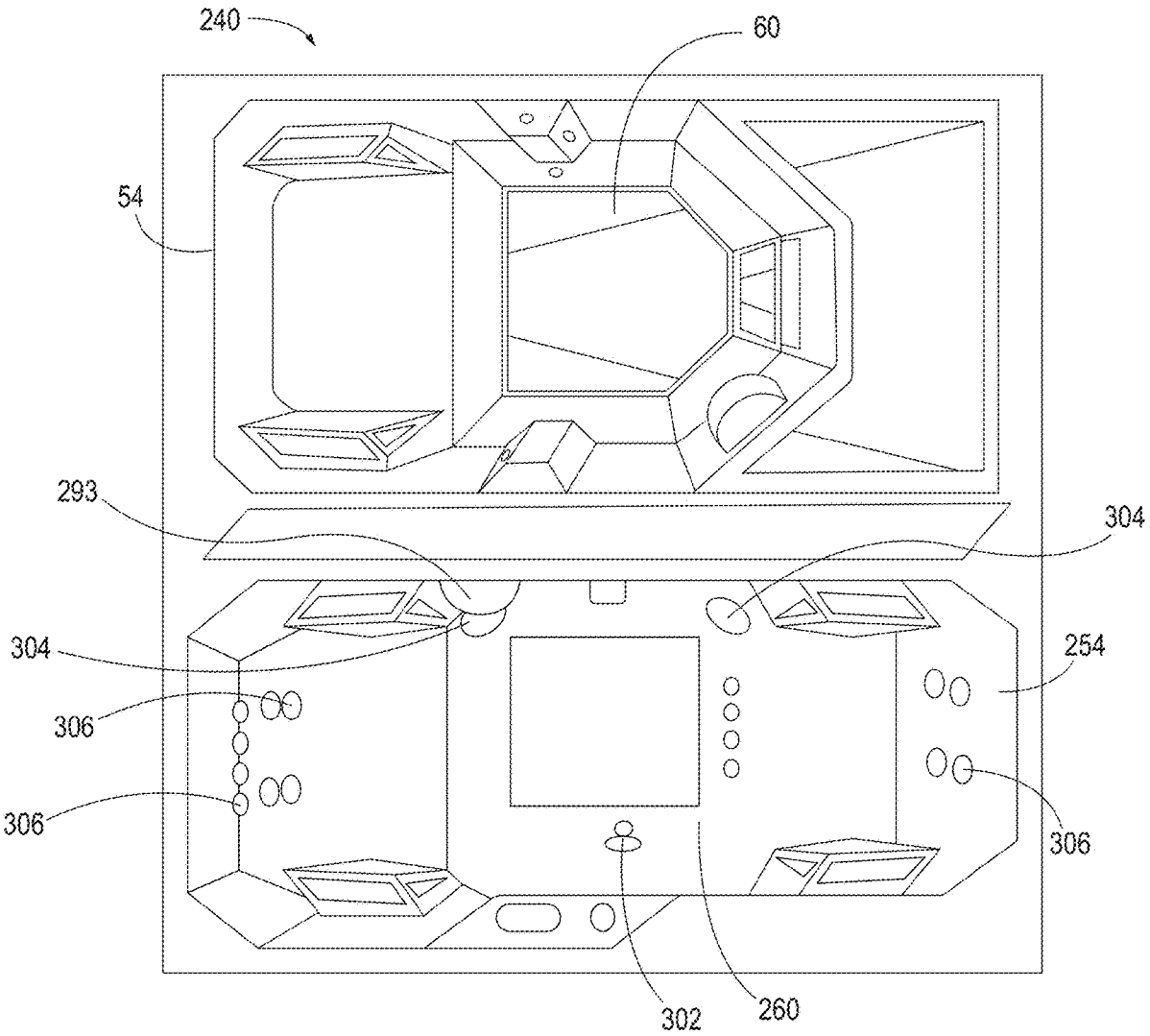

FIG. 7C is an enlarged top view of the hot tub 254 of the spa shell 240 illustrated in FIG. 7A, The water holding compartment 260 of the hot tub 254 includes a floor wall 270, an irregular-shaped annular floor connecting wall 272, a first lateral sidewall 280 adjacent to the water holding compartment 60 of the cold tub 54 (FIG. 7A), a second lateral sidewall 282 opposite the first lateral sidewall 280, opposing first and second backrest sidewalls 284, 285, and first and second seat-walls 286 and 287. The first seat-wall 286 and the first backrest sidewall 284 define a first seating area FSA and the second seat-wall 287 and the second backrest sidewall 285 define a second seating area SSA. The second lateral sidewall 282 is stepped thereby providing the second backrest sidewall 285 and the second seat-wall 287 with a greater width than the first backrest sidewall 284 and the first seat-wall 286. Therefore, the second seating area SSA is wider than the first seating area FSA. The annular floor connecting wall 272 of the water holding compartment 260 is formed by a plurality of floor connecting wall sections 274. The first and second lateral sidewalls 280 and 282 include first and second pairs of bumped-out areas 290 and 292 that respectively protrude into first and second seating areas FSA and SSA and define armrests 294. Each armrest 294 is formed by a top wall 296, a sidewall 298, and an upwardly facing angled front wall 300. As shown in FIG. 7D, the water holding compartment 260 of the hot tub 254 can also include a skimmer 293 which operates as a filter and a water inlet for a water circulation pump and a heater of the hot water circulation-temperature system of the hot tub 254, a heated water return 302 that is powered by the water circulation pump, suction inlets for a jet pump of the hot water circulation and water temperature and treatment system of the hot tub 254, a plurality of water jets 306 that are powered by the jet pump.

Referring again to FIG. 7B, the water holding compartment 60 of the cold tub 54 includes the same non-slip hot and cold thermal insulative laminates as described earlier referencing FIGS. 2, 3A, and 3B. Therefore, a non-slip laminate of hot and cold thermal insulative material is adhered to the exterior facing surface of each of the top deck wall 120 (non-slip laminate 170), the central sidewall 83 of the equipment sidewall 80 (non-slip laminate 172), the front central connecting wall section 78 of the annular floor connecting wall 72 (non-slip laminate 174), the floor wall 70 (non-slip laminate 176), the top wall 106 of the armrest 104 (non-slip laminate 178), and the angled front wall 110 of the armrest 104 (non-slip laminate 180).

Referring again to FIG. 7C, the water holding compartment 260 of the hot tub 254 includes a non-slip laminate adhered to the exterior facing surface of each of the floor wall 270 (non-slip laminate 310), the top wall 296 of each armrest 294 (non-slip laminate 312), and the angled front wall 300 of each armrest 294 (non-slip laminate 314). The non-slip laminates 310, 312, and 314 can be made of same non-slip hot and cold thermal insulative material and construction as the non-slip hot and cold thermal insulative laminates described earlier referencing FIGS. 2, 3A, and 3B or can be made of another type of non-slip material that does not have hot and cold thermal insulative properties.

Referring again to FIG. 7A, the separation top wall 225 of the spa shell 240 includes a non-slip laminate 316 adhered to the exterior facing surface thereof. The non-slip laminate 316 can be made of same non-slip hot and cold thermal insulative material and construction as the non-slip hot and cold thermal insulative laminates described earlier referencing FIGS. 2, 3A, and 3B or can be made of another type of non-slip material that does not have hot and cold thermal insulative properties.

Figure 8:
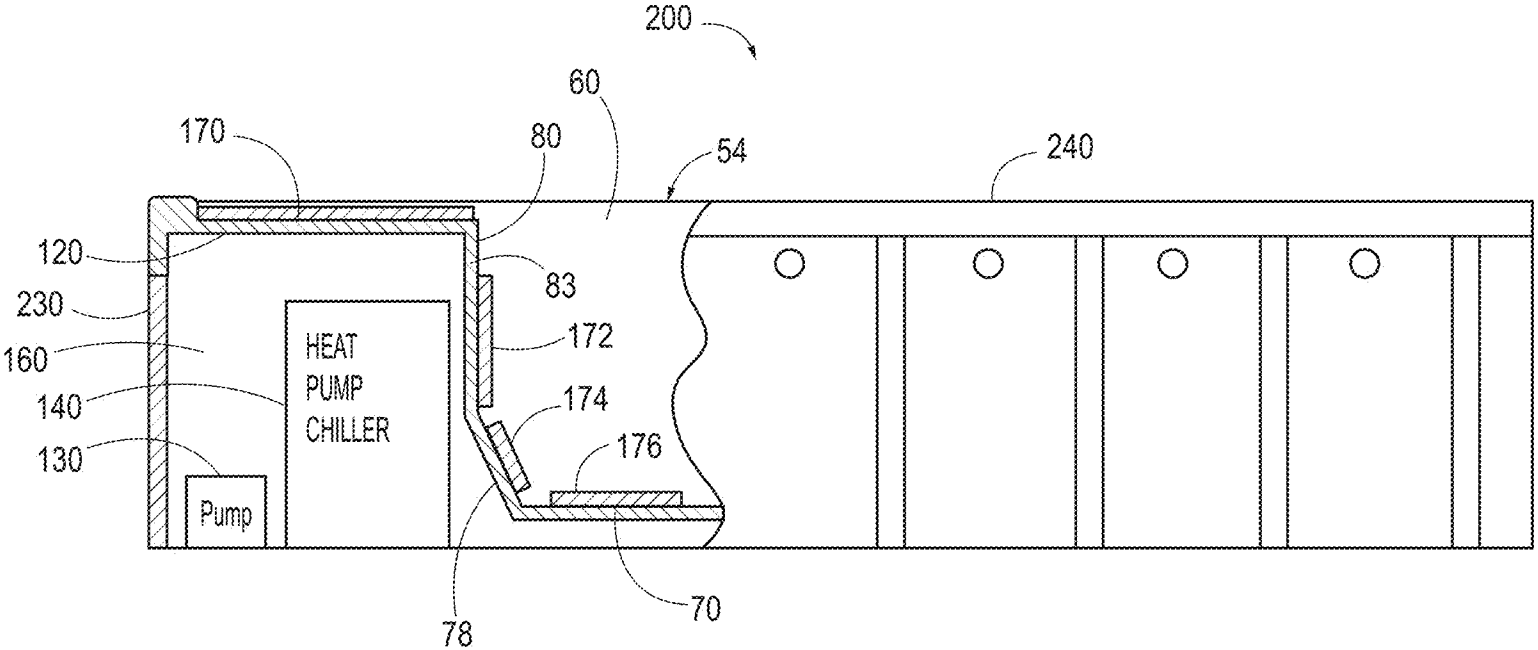
FIG. 8 is a side elevational view of the spa of FIG. 6 with a portion thereof in section illustrating an equipment space of the spa, according to an illustrative embodiment of the present disclosure.

The non-slip laminates 170, 172, 174, 176, 178, 180, 310, 312, 314, and 316 allow a user to enter, exit, and move about the cold tub 54 and/or the hot tub 254 of the spa 200 in a safe manner without slipping on the surfaces they are adhered to. In addition, the non-slip laminates 170, 172, and 174 are further operative for thermally isolating the hot and cold air generated by the heat pump chiller 140 of the water circulation-temperature system housed within the spa cabinet 230 in the equipment space 160 defined within the spa cabinet 230, underneath the top deck wall 120 of the spa shell 240, as illustrated in FIG. 8. Specifically, the non-slip thermal insulating laminates 170, 172 and 174 adhered to the exterior surfaces of the top deck wall 120, the central sidewall 83 of the equipment wall 80 and the front central connecting wall section 78 of the annular floor connecting wall 72 of the water holding compartment 60, are operative for preventing the heat in the hot air generated in the equipment space 160 (FIG. 8) by the evaporator 144 of the heat pump chiller 140, when the heat pump chiller 140 is set in the cooling mode (FIG. 5B), from being transferred into the cooled water $\mathbf{133}_{COOLED}$ contained in the water holding compartment 60 of the spa shell 240, by the central sidewall 83 and the front central connecting wall section 78 of the water holding compartment 60. If no non-slip thermal insulating laminates 170, 172, and 174 were provided on the exterior surfaces of the top deck wall 120, the central sidewall 83, and the front central connecting wall section 78, respectively, the heat in the hot air of the equipment space 160 could be easily transferred into the cooled water $\mathbf{133}_{COOLED}$ contained in the water holding compartment 60 of the spa shell 240, thereby undesirably raising the temperature of the water contained in the water holding compartment 60 during the operation of the heat chiller pump 140 in the cooling mode.

The cold air generated in the equipment space 160 by the operation of the evaporator 144, when the heat pump chiller 140 is set in the heating mode (FIG. 5C), lowers the temperature of the top deck wall 120, the central sidewall 83 and front central connecting wall section 78 of the water holding compartment 60 of the spa shell 240. The non-slip thermal insulating laminates 170, 172, 174 adhered to the exterior surfaces of the top deck wall 120, the central sidewall 83, and the front central connecting wall section 78, respectively, are operative for preventing the top deck wall 120, the central sidewall 83 and the cold front central connecting wall section 78, which have been cooled by cold air in the equipment space 160 (FIG. 8), from absorbing heat out of the heated water $\mathbf{133}_{HEATED}$ contained in the water holding compartment 60 of the spa shell 240. If no non-slip thermal insulating laminates 170, 172, and 174 were provided on the exterior surfaces of the top deck wall 120, the central sidewall 83 and the front central connecting wall section 78, respectively, the cooled top deck wall 120, central sidewall 83 and front central connecting wall section 78 would be free to absorb the heat from the heated water $\mathbf{133}_{HEATED}$ contained in the water holding compartment 60 of the spa shell 240, thereby undesirably lowering the temperature of the water.

The hot water circulation-temperature system for the hot tub 254 is well-known in the spa art and typically includes a water circulation pump, jet water pump, water heater, plumbing, and the like (not shown). The components of the hot tub circulation-temperature system can be spread apart and located around the water compartment 260 of the hot tub 254 of the spa shell 240 adjacent to the spa cabinet 230.

It should be understood that the invention is not limited to the embodiments illustrated and described herein. Rather, the appended claims should be construed broadly to include other variants and embodiments of the invention, which may be made by those skilled in the art without departing from the scope and range of equivalents of the invention. It is indeed intended that the scope of the invention should be determined by proper interpretation and construction of the appended claims and their legal equivalents, as understood by those of skill in the art relying upon the disclosure in this specification and the attached drawings.

What is claimed is:

1. A spa shell for a spa, the spa shell comprising:

a water holding compartment that is operative as a cold tub, the water holding compartment defining a seating area, the water holding compartment including:

a floor wall;

an equipment sidewall; and a floor connecting wall connecting the floor wall with the equipment sidewall; and a non-slip laminate of thermal insulative material disposed on an exterior surface of the equipment sidewall, the non-slip laminate of thermal insulative material for thermally isolating the exterior surface of the equipment sidewall.

2. The spa shell of claim 1, further comprising a non-slip laminate of thermal insulative material disposed on an exterior surface of the floor connecting wall, the non-slip laminate of thermal insulative material for thermally isolating the exterior surface of the floor connecting wall.

3. The spa shell of claim 1, further comprising a top deck wall extending from the water holding compartment toward an end of the spa shell.

4. The spa shell of claim 3, further comprising a non-slip laminate of thermal insulative material disposed on an exterior surface of the top deck wall, the non-slip laminate of thermal insulative material for thermally isolating the exterior surface of the top deck wall.

5. The spa shell of claim 1, further comprising a non-slip laminate disposed on an exterior surface of the floor wall.

6. The spa shell of claim 1, wherein the water holding compartment further includes a backrest sidewall and a seat-wall, the backrest sidewall and the seat-wall forming the seating area.

7. The spa shell of claim 6, wherein the water holding compartment further includes a lateral sidewall, the lateral sidewall including a bumped-out area protruding into the seating area and thereby defining an armrest.

8. The spa shell of claim 7, further comprising a non-slip laminate disposed on an exterior surface of the armrest.

9. The spa shell of claim 1, further comprising a second water holding compartment that is operative as a hot tub, the second water holding compartment defining a seating area, the second water holding compartment including a floor wall and a non-slip laminate disposed on an exterior surface of the floor wall.

10. The spa shell of claim 9, wherein the second water holding compartment further includes a backrest sidewall and a seat-wall, the backrest sidewall and the seat-wall forming the seating area.

11. The spa shell of claim 10, wherein the second water holding compartment further includes a lateral sidewall, the lateral sidewall including a bumped-out area protruding into the seating area of the second water holding compartment and thereby defining an armrest.

12. The spa shell of claim 11, further comprising a non-slip laminate disposed on an exterior surface of the armrest defined by the bumped-out area protruding into the seating area of the second water holding compartment.

13. The spa shell of claim 9, further comprising a separation top wall that extends parallel with and separates the water compartment that is operative as the cold tub from the second water compartment that is operative as the hot tub.

14. The spa shell of claim 13, further comprising a non-slip laminate disposed on an exterior surface of the separation top wall.

15. The spa shell of claim 1, wherein the non-slip laminate of thermal insulative material comprises at least one layer of Polyethylene (PE) foam or Ethylene Vinyl Acetate (EVA) foam.

16. A spa comprising:

a spa shell comprising:

a water holding compartment that is operative as a cold tub, the water holding compartment defining a seating area, the water holding compartment including:

a floor wall;

an equipment sidewall; and a floor connecting wall connecting the floor wall with the equipment sidewall;

a heat pump located opposite an interior surface of the equipment side wall; and a non-slip laminate of thermal insulative material disposed on an exterior surface of the equipment sidewall, the non-slip laminate of thermal insulative material for thermally isolating the exterior surface of the equipment sidewall from hot and/or cold air generated by the heat pump.

17. The spa of claim 16, wherein the heat pump is also located opposite an interior surface of the floor connecting wall and further comprising a non-slip laminate of thermal insulative material disposed on an exterior surface of the floor connecting wall, the non-slip laminate of thermal insulative material for thermally isolating the exterior surface of the floor connecting wall from hot and/or cold air generated by the heat pump.

18. The spa of claim 16, the spa shell further comprises a top deck wall extending from the water holding compartment of the cold tub toward an end of the spa shell.

19. The spa of claim 18, wherein the heat pump is also located opposite an interior surface of the top deck wall and further comprising a non-slip laminate of thermal insulative material disposed on an exterior surface of the top deck wall, the non-slip laminate of thermal insulative material for thermally isolating the exterior surface of the top deck wall from hot and/or cold air generated by the heat pump.

20. The spa of claim 16, further comprising a non-slip laminate disposed on an exterior surface of the floor wall.

21. The spa of claim 16, wherein the water holding compartment further includes a backrest sidewall and a seat-wall, the backrest sidewall and the seat-wall forming the seating area.

22. The spa of claim 21, wherein the water holding compartment further includes a lateral sidewall, the lateral sidewall including a bumped-out area protruding into the seating area and thereby defining an armrest.

23. The spa of claim 22, further comprising a non-slip laminate disposed on an exterior surface of the armrest.

24. The spa of claim 16, wherein the spa shell further comprises a second water holding compartment that is operative as a hot tub, the second water holding compartment defining a seating area, the second water holding compartment including a floor wall and a non-slip laminate disposed on an exterior surface of the floor wall.

25. The spa of claim 24, wherein the second water holding compartment further includes a backrest sidewall and a seat-wall, the backrest sidewall and the seat-wall forming the seating area.

26. The spa of claim 25, wherein the second water holding compartment further includes a lateral sidewall, the lateral sidewall including a bumped-out area protruding into the seating area of the second water holding compartment and thereby defining an armrest.

27. The spa of claim 26, further comprising a non-slip laminate disposed on an exterior surface of the armrest defined by the bumped-out area protruding into the seating area of the second water holding compartment.

28. The spa of claim 24, wherein the spa shell further comprises a separation top wall that extends parallel with and separates the water compartment that is operative as the cold tub from the second water compartment that is operative as the hot tub.

29. The spa of claim 28, further comprising a non-slip laminate disposed on an exterior surface of the separation top wall.

30. The spa of claim 16, wherein the non-slip laminate of thermal insulative material comprises at least one layer of Polyethylene (PE) foam or Ethylene Vinyl Acetate (EVA) foam.

* * * * *